US006310029B1

(12) United States Patent
Kilgour et al.

(10) Patent No.: US 6,310,029 B1
(45) Date of Patent: Oct. 30, 2001

(54) CLEANING PROCESSES AND COMPOSITIONS

(75) Inventors: John A. Kilgour, Clifton Park; Robert J. Perry, Niskayuna, both of NY (US)

(73) Assignee: General Electric Company, Pittsfield, MA (US)

( * ) Notice: Subject to any disclaimer, the term of this patent is extended or adjusted under 35 U.S.C. 154(b) by 0 days.

(21) Appl. No.: 09/289,299

(22) Filed: Apr. 9, 1999

(51) Int. Cl.[7] ..... C11D 3/38; C11D 17/04; D06L 1/02; D06L 1/04; D06L 11/26

(52) U.S. Cl. ..... 510/466; 510/285; 8/142

(58) Field of Search ..... 8/137, 137.5, 142; 510/466, 285, 289

(56) References Cited

U.S. PATENT DOCUMENTS

| | | | | |
|---|---|---|---|---|
| 2,176,705 | * | 10/1939 | Derby | 8/139.1 |
| 2,697,075 | * | 12/1954 | Echols | 252/110 |
| 2,941,952 | * | 6/1960 | Lewis et al. | 252/161 |
| 3,123,494 | * | 3/1964 | Charreau | 117/62 |
| 3,630,660 | * | 12/1971 | Wedler | 8/139 |
| 4,005,231 | | 1/1977 | Smith | 427/387 |
| 4,065,258 | | 12/1977 | France | 8/142 |
| 4,115,061 | * | 9/1978 | Grünewälder | 8/137 |
| 4,136,045 | * | 1/1979 | Gault et al. | 252/135 |
| 4,501,682 | * | 2/1985 | Goodman et al. | 252/174.15 |
| 4,685,930 | | 8/1987 | Kasprzak | 8/139.1 |
| 4,708,807 | * | 11/1987 | Kemerer | 252/8.6 |
| 4,911,853 | | 3/1990 | Coffindaffer et al. | 252/8.8 |
| 4,961,753 | * | 10/1990 | Donkers et al. | 8/115.68 |
| 5,219,371 | * | 6/1993 | Shim et al. | 8/149.1 |
| 5,301,379 | * | 4/1994 | Schaal | 8/158 |
| 5,302,313 | | 4/1994 | Asano et al. | 252/171 |
| 5,309,587 | | 5/1994 | Fierro | 8/158 |
| 5,357,771 | | 10/1994 | Schaal | 68/18 |
| 5,503,681 | * | 4/1996 | Inaoki et al. | 134/1 |
| 5,676,705 | * | 10/1997 | Juseller et al. | 8/142 |
| 5,683,977 | * | 11/1997 | Jureller et al. | 510/286 |
| 5,702,535 | | 12/1997 | Gray et al. | 134/10 |
| 5,716,456 | * | 2/1998 | Inada et al. | 134/10 |
| 5,728,228 | * | 3/1998 | Inada et al. | 134/10 |
| 5,741,365 | * | 4/1998 | Inada et al. | 134/1 |
| 5,741,367 | * | 4/1998 | Inada et al. | 134/10 |
| 5,773,403 | * | 6/1998 | Hijino et al. | 510/411 |
| 5,833,761 | | 11/1998 | Inada et al. . | |
| 5,834,416 | | 11/1998 | Morgan et al. . | |
| 5,865,852 | | 2/1999 | Berndt | 8/142 |
| 5,883,067 | * | 3/1999 | Kubo et al. | 510/400 |
| 5,942,007 | * | 8/1999 | Berndt et al. | 8/142 |
| 5,977,040 | * | 11/1999 | Inada et al. | 510/165 |
| 5,977,045 | * | 11/1999 | Murphy et al. | 510/289 |
| 5,985,810 | * | 11/1999 | Fusda et al. | 510/175 |

FOREIGN PATENT DOCUMENTS

| | | |
|---|---|---|
| 06327888 | 11/1994 | (JP) . |
| 09299687 | 11/1997 | (JP) . |
| W/O 9401510 | 1/1994 | (WO) . |
| WO 99/10587 | 4/1999 | (WO) . |

OTHER PUBLICATIONS

Detergent & Personal Care; Chem. Mark. Rep., Dec. 15, 1997, 252 (24), p. 15.

* cited by examiner

*Primary Examiner*—Yogendra N. Gupta
*Assistant Examiner*—John M Petruncio

(57) ABSTRACT

A method for cleaning an article comprises contacting the article with a cleaning composition comprising a linear or branched volatile siloxane.

13 Claims, No Drawings

CLEANING PROCESSES AND COMPOSITIONS

TECHNICAL FIELD

The present invention is directed to a composition, more specifically, to a siloxane fluid based composition, for use in dry cleaning and to a dry cleaning process using the composition.

BACKGROUND

Current dry cleaning technology uses perchloroethylene ("PERC") or petroleum-based materials as the cleaning solvent. PERC suffers from toxicity and odor issues. The petroleum-based products are not as effective as PERC in cleaning garments.

Linear volatile siloxanes and cyclic siloxanes have been reported as spot cleaning solutions, see U.S. Pat. No. 4,685,930. Other patents disclose the use of silicone soaps in petroleum solvents, see JP 09299687, and the use of silicone surfactants in super critical carbon dioxide solutions has been reported, see, for example, U.S. Pat. No. 5,676,705 and Chem. Mark. Rep., Dec. 15 1997, 252(24), p. 15. Non-volatile silicone oils have also been used as the cleaning solvent requiring removal by a second washing with perfluoroalkane to remove the silicone oil, see JP 06327888.

Numerous other patents have issued in which siloxanes or organomodified silicones have been present as addenda in PERC or petroleum based dry cleaning solvents, see, for example, WO 9401510; U.S. Pat. Nos. 4,911,853; 4,005,231; 4,065,258.

SUMMARY OF THE INVENTION

In a first aspect, the present invention is directed to a method for cleaning an article, comprising contacting the article with a composition comprising a linear or branched volatile siloxane.

In a second aspect, the present invention is directed to a cleaning composition, which, in a first preferred embodiment, comprises a linear or branched volatile siloxane and a surfactant.

In a second preferred embodiment, the cleaning composition comprises a branched or linear volatile siloxane and a cyclic siloxane.

The process of the present invention is effective in removing both non-polar stains, such as for example, oil and sebum, and polar stains, such as, for example, salts, components of coffee, tea and grape juice, from the article, for example, a garment, being cleaned and in suppressing redeposition of soil on the article.

DETAILED DESCRIPTION OF THE INVENTION

Preferably, the first preferred embodiment of the cleaning composition of the present invention comprises, based on 100 parts by weight ("pbw") of the composition, from 80 pbw to 99.99 pbw, more preferably from 90 pbw to 99.9 pbw and even more preferably from 92 pbw to 99.5 pbw of the linear or branched volatile siloxane and from 0.01 pbw to 20 pbw, more preferably from 0.1 pbw to less than 10 pbw and even more preferably from 0.5 pbw to 8 pbw of the surfactant. In a preferred embodiment, the cleaning composition further comprises, based on 100 pbw of the composition, up to 10 pbw, more preferably from 0.01 pbw to 10 pbw, even more preferably from 0.1 pbw to 5 pbw, even more preferably 0.5 pbw to 2 pbw water.

Preferably, the second preferred embodiment of the cleaning composition of the present invention comprises, based on 100 pbw of the composition, from 0.1 pbw to 99.9 pbw, more preferably from 50.1 pbw to 99 pbw and even more preferably from 80 pbw to 99 pbw of the linear or branched volatile siloxane and from 0.1 pbw to 99.9 pbw, more preferably from pbw 1 to 49.99 pbw and even more preferably from 1 pbw to 20 pbw of the cyclic siloxane. In a preferred embodiment, the cleaning composition further comprises, based on 100 pbw of the composition, up to 10 pbw, more preferably from 0.01 pbw to 10 pbw, even more preferably from 0.1 pbw to 5 pbw, even more preferably 0.5 pbw to 2 pbw water.

Compounds suitable as the linear or branched, volatile siloxane component of the present invention are those containing a polysiloxane structure that includes from 2 to 20 silicon atoms. Preferably, the linear or branched, volatile siloxanes are relatively volatile materials, having, for example, a boiling of below about 300° C. point at a pressure of 760 millimeters of mercury ("mm Hg").

In a preferred embodiment, the linear or branched, volatile siloxane comprises one or more compounds of the structural formula (I):

$$M_{2+y+2z}D_xT_yQ_z \qquad (I)$$

wherein:

M is $R^1{}_3SiO_{1/2}$;

D is $R^2{}_2SiO_{2/2}$;

T is $R^3SiO_{3/2}$;

and Q is $SiO_{4/2}$ $R^1$, $R^2$ and $R^3$ are each independently a monovalent hydrocarbon radical; and x and y are each integers, wherein $0 \leqq x \leqq 10$ and $0 \leqq y \leqq 10$ and $0 \leqq z \leqq 10$ Suitable monovalent hydrocarbon groups include acyclic hydrocarbon radicals, monovalent alicyclic hydrocarbon radicals, monovalent and aromatic hydrocarbon radicals. Preferred monovalent hydrocarbon radicals are monovalent alkyl radicals, monovalent aryl radicals and monovalent aralkyl radicals.

As used herein, the term "$(C_1–C_6)$alkyl" means a linear or branched alkyl group containing from 1 to 6 carbons per group, such as, for example, methyl, ethyl, propyl, isopropyl, n-butyl, iso-butyl, sec-butyl, tert-butyl, pentyl, hexyl, preferably methyl.

As used herein, the term "aryl" means a monovalent unsaturated hydrocarbon ring system containing one or more aromatic rings per group, which may optionally be substituted on the one or more aromatic rings, preferably with one or more $(C_1–C_6)$alkyl groups and which, in the case of two or more rings, may be fused rings, including, for example, phenyl, 2,4,6-trimethylphenyl, 2-isopropylmethylphenyl, 1-pentalenyl, naphthyl, anthryl, preferably phenyl.

As used herein, the term "aralkyl" means an aryl derivative of an alkyl group, preferably a $(C_2–C_6)$alkyl group, wherein the alkyl portion of the aryl derivative may, optionally, be interrupted by an oxygen atom, such as, for example, phenylethyl, phenylpropyl, 2-(1-naphthyl)ethyl, preferably phenylpropyl, phenyoxypropyl, biphenyloxypropyl.

In a preferred embodiment, the monovalent hydrocarbon radical is a monovalent $(C_1–C_6)$alkyl radical, most preferably, methyl.

In a preferred embodiment, the linear or branched, volatile siloxane comprises one or more of, hexamethyldisiloxane, octamethyltrisiloxane, decamethyltetrasiloxane, dodecamethylpentasiloxane, tetradecamethylhexasiloxane or hexadecamethylheptasiloxane or methyltris(trimethylsiloxy)silane. In a more highly preferred embodiment, the linear or branched, volatile siloxane of the present invention comprises octamethyltrisiloxane, decamethyltetrasiloxane, or dodecamethylpentasiloxane or methyltris(trimethylsiloxy)silane. In a highly preferred embodiment, the siloxane component of the composition of the present invention consists essentially of decamethyltetrasiloxane.

Suitable linear or branched volatile siloxanes are made by known methods, such as, for example, hydrolysis and condensation of one or more of tetrachlorosilane, methyltrichlorosilane, dimethyldichlorosilane, trimethylchlorosilane, or by isolation of the desired fraction of an equilibrate mixture of hexamethyldisiloxane and octamethylcyclotetrasiloxane or the like and are commercially available.

Compounds suitable as the cyclic siloxane component of the present invention are those containing a polysiloxane ring structure that includes from 2 to 20 silicon atoms in the ring. Preferably, the linear, volatile siloxanes and cyclic siloxanes are relatively volatile materials, having, for example, a boiling point of below about 300° C. at a pressure of 760 millimeters of mercury ("mm Hg").

In a preferred embodiment, the cyclic siloxane component comprises one or more compounds of the structural formula (II):

(II)

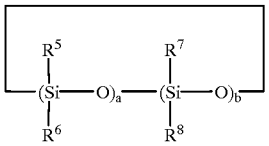

wherein:

$R^5$, $R^6$, $R^7$ and $R^8$ are each independently a monovalent hydrocarbon group; and a and b are each integers wherein $0 \leqq a \leqq 10$ and $0 \leqq b \leqq 10$, provided that $3 \leqq (a+b) \leqq 10$.

In a preferred embodiment, the cyclic siloxane comprises one or more of, octamethylcyclotetrasiloxane, decamethylcyclopentasiloxane, dodecamethylcyclohexasiloxane, tetradecamethylcycloheptasiloxane. In a more highly preferred embodiment, the cyclic siloxane of the present invention comprises octamethylcyclotetrasiloxane or decamethylcyclopentasiloxane. In a highly preferred embodiment, the cyclic siloxane component of the composition of the present invention consists essentially of decamethylcyclopentasiloxane.

Suitable cyclic siloxanes are made by known methods, such as, for example, hydrolysis and condensation of dimethyldichlorosilane and are commercially available.

It is believed that those cleaning compositions according to the present invention that lack a cyclic siloxane component would be more stable than those which include a cyclic siloxane component, in that cyclic siloxanes are known to ring open and polymerize under acidic and basic conditions.

The surfactant component of the cleaning compositions of the present invention may comprise one or more surfactants, including anionic, nonionic, Zwitterionic and amphoteric surfactants, that contains a moiety, such as for example, a polyalkylsiloxane moiety, that is soluble in the volatile siloxane component of the cleaning composition of the present invention and a moiety capable of compatiblizing any of a range of targeted staining components. Suitable surfactants include, for example, alkylbenzene sulfonates, ethoxylated alkyl phenols, ethoxylated fatty alcohols, alkylester alkoxylates, alkyl sulfonates, quaternary ammonium complexes, block propyleneoxide, ethyleneoxide copolymers, sorbitan fatty esters, sorbitan ethoxylates, Tergitols, tridecylalcohol ethoxylates, alkanolamides, sodium lauryl sulfonate, sodium stearate, sodium laureth sulfate, ammonium lauryl ether sulfonate, and silicone surfactants, such as for example, quaternary alkyl ammonium siloxanes, carboxyalkyl siloxanes, and polyether siloxane surfactants. In a preferred embodiment, the surfactant exhibits an hydrophilic-lipophilic balance ("HLB") of from 3 to 14, more preferably 5 to 11, as for example polyether siloxanes. Surfactants are generically known in the art and are available from a number of commercial sources.

In a preferred embodiment, the surfactant component of the present invention comprises one or more polyether siloxane compounds those according to the structural formula III:

$$M_e D_f D^*_g M^*_{2-e} \quad \text{(III)}$$

wherein:

M is $R^9{}_3SiO_{1/2}$;

D is $R^{10}{}_2SiO_{2/2}$;

M* is $R^{11}{}_3SiO_{1/2}$;

D* is $R^{12}{}_2SiO_{2/2}$;

each $R^9$, $R^{10}$ is independently H, a monovalent hydrocarbon group.

each $R^{11}$ is independently H, a monovalent hydrocarbon group, or $-(CH_2)_h-O-(C_2H_4O)_i-(C_3H_6O)_j-(C_nH_{2n}O)_k-R^{13}$, provided that at least one $R^{11}$ is $-(CH_2)_h-O-(C_2H_4O)_i-(C_3H_6O)_j-(C_nH_{2n}O)_k-R^{13}$;

each $R^{12}$ is independently H, a monovalent hydrocarbon group, or $-(CH_2)_h-O-(C_2H_4O)_i-(C_3H_6O)_j-(C_nH_{2n}O)_k-R^{13}$, provided that at least one $R^{12}$ is $-(CH_2)_h-O-(C_2H_4O)_i-(C_3H_6O)_j-(C_nH_2O)_k-R^{13}$;

$R^{13}$ is H, a monovalent hydrocarbon group or alkyloxy;

$0 \leqq e \leqq 2$;

$0 \leqq f \leqq 1000$;

$0 \leqq g \leqq 50$, provided that $g \geqq 1$ if e is 2;

$1 \leqq h \leqq 16$;

$0 \leqq i \leqq 30$;

$0 \leqq j \leqq 30$;

$0 \leqq k \leqq 30$; and $4 \leqq n \leqq 8$, provided that $i+j+k>0$.

In a preferred embodiment, $2 \leqq i \leqq 25$, $0 \leqq j \leqq 25$ and $0 \leqq k \leqq 25$, more preferably k is 0.

The composition of the present invention may, optionally, contain other components, such as, for example, fabric conditioner, brighteners, bleaching agents, enzymes, water-repellent treatments, anti-static agents, fragrances and detergents.

In a preferred embodiment, the cleaning composition of the present invention further comprises a minor amount, preferably, less than 50 pbw per 100 pbw of the composition, and, more preferably, less than 10 pbw per 100 pbw of the composition, of one or more non-siloxane fluids. Suitable non-siloxane fluids include aqueous fluids, such as, for example, water, and organic fluids, for example, hydrocarbon fluids and halogenated hydrocarbon fluids.

An article, such as for example, a textile or leather article, typically, a garment, is dry cleaned by contacting the article with the composition of the present invention. In a preferred embodiment, the articles to be cleaned include textiles made from natural fibers, such as for example, cotton, wool, linen and hemp, from synthetic fibers, such as, for example, polyester fibers, polyamide fibers, polypropylene fibers and elastomeric fibers, from blends of natural and synthetic fibers, from natural or synthetic leather or natural or synthetic fur.

In a first embodiment of the method of the present invention, a cleaning composition is applied to at least a localized area of the article to be cleaned by, for example, pouring, spraying, brushing or rubbing onto a stained area and then removed, for example, by blotting with a dry absorbent material, such as a sponge, cloth towel or paper towel.

In a second embodiment of the method of the present invention, the article to be cleaned is immersed in a cleaning composition. The article and cleaning composition are then separated, by, for example, one or more of draining and centrifugation. In a preferred embodiment, separation of the article and cleaning composition is followed by the application of heat, preferably, heating to a temperature of from 15° C. to 120° C., preferably from 20° C. to 100° C., or reduced pressure, preferably, a pressure of from 1 mm Hg to 750 mm Hg, or by application of heat and reduced pressure, to the article.

The cleaning method of the present invention removes particulate soils, such as for example, insoluble particles such as silicates, carbon black, as well as both polar stains, such as for example, salts, sugars, water soluble biological fluids, and nonpolar stains, such as, for example, hydrocarbons, oils, greases, sebum, from the garment and prevents the redeposition of the soils, polar stains and nonpolar stains on the article.

EXAMPLES 1–162

The respective cleaning compositions used in Examples 1–162 were each prepared by combining the components listed below in the relative amounts set forth below in TABLES I–XIV below:

methyl terminated tetradimethyl siloxane ("$MD_2M$");

decamethylcyclopentasiloxane ("$D_5$");

polyether siloxane compounds, each according to structural formula III above, were used:

| Polyether siloxane | e | f | g | Ratio $C_2H_4O$: $C_3H_6O$ | Number average molecular weight ($MW_n$) of polyether substituent | $R^{13}$ |
|---|---|---|---|---|---|---|
| A | 2 | 20 | 3 | 50:50 | 1700 | H |
| B | 2 | 15 | 5 | 100:0 | 550 | H |
| C | 0 | 3 | 0 | 100:0 | 900 | H |
| D | 0 | 3 | 0 | 100:0 | 200 | H |
| E | 2 | 500 | 6.5 | 50:50 | 1700 | H |
| F | 2 | 400 | 18 | 100:0 | 550 | H |

A first set of textile samples (2"×2" squares of red satin textile) were soiled with polar stains by pipetting droplets of an 8 wt % aqueous sodium chloride solution on each of the textile samples of the set. A second set of textile samples were soiled with nonpolar stains by pipetting droplets of fresh motor oil (Quaker State SAE 10W-30) on each of the textile samples of the set. Each of the dry cleaning compositions was then placed in a 4 ounce bottle. Each of the soiled textile samples was contacted with a respective one of the cleaning compositions by immersing the soiled textile sample in 50 g of one of the cleaning compositions. The textile samples and cleaning compositions were agitated by gently shaking each of the bottles. Following agitation, each of the textile samples was removed from the cleaning composition, allowed to drain, blotted and then heated at ~50° C. to dry the samples. The appearance of each of the dried textile samples was then evaluated by visual inspection and rated on the following scale (an average of three readings is reported):

Rating 5 = complete removal of stain

4 = slight stain remaining

3 = moderate stain removal

2 = slight stain removal

1 = no stain removal

The amounts of linear, branched and cyclic siloxanes, polyether siloxane and water used in each of Examples 1–130, as well as the type of stain and the results obtained in each of those examples are set forth in TABLES I–IX below.

| EX # | $MD_2M$, Amount (g) | Stain | Polyether Siloxane | Polyether Siloxane, Amount (g) | $H_2O$, Amount (g) | Cleaning |
|---|---|---|---|---|---|---|
| 1 | 49.5 | Salt | — | — | — | 2.7 |
| 2 | 49.5 | Salt | A | 0.5 | — | 4 |
| 3 | 49 | Salt | A | 0.5 | 0.5 | 4.3 |
| 4 | 49.5 | Salt | F | 0.5 | — | 3.7 |
| 5 | 49 | Salt | F | 0.5 | 0.5 | 3.7 |
| 6 | 49.5 | Salt | B | 0.5 | — | 4 |
| 7 | 49 | Salt | B | 0.5 | 0.5 | 4 |
| 8 | 49.5 | Salt | C | 0.5 | — | 3.3 |
| 9 | 49 | Salt | C | 0.5 | 0.5 | 4 |
| 10 | 49.5 | Salt | D | 0.5 | — | 5 |
| 11 | 49 | Salt | D | 0.5 | 0.5 | 4 |
| 12 | 49.5 | Salt | E | 0.5 | — | 3.3 |
| 13 | 49 | Salt | E | 0.5 | 0.5 | 4.3 |
| 14 | 49.5 | Salt | B/E | 0.25/0.25 | — | 4 |
| 15 | 49 | Salt | B/E | 0.25/0.25 | 0.5 | 4.7 |

TABLE II

| EX # | $MD_2M$, Amount (g) | Stain | Polyether Siloxane | Polyether Siloxane, Amount (g) | $H_2O$, Amount (g) | Cleaning |
|---|---|---|---|---|---|---|
| 16 | 47.5 | Salt | — | — | — | 2.7 |
| 17 | 47.5 | Salt | A | 2.5 | — | 4 |
| 18 | 47 | Salt | A | 2.5 | 0.5 | 5 |
| 19 | 47.5 | Salt | F | 2.5 | — | 4 |
| 20 | 47 | Salt | F | 2.5 | 0.5 | 4.7 |
| 21 | 47.5 | Salt | B | 2.5 | — | 4.7 |
| 22 | 47 | Salt | B | 2.5 | 0.5 | 4.7 |
| 23 | 47.5 | Salt | C | 2.5 | — | 3.7 |
| 24 | 47 | Salt | C | 2.5 | 0.5 | 5 |
| 25 | 47.5 | Salt | D | 2.5 | — | 4.3 |
| 26 | 47 | Salt | D | 2.5 | 0.5 | 5 |
| 27 | 47.5 | Salt | E | 2.5 | — | 4 |
| 28 | 47 | Salt | E | 2.5 | 0.5 | 4.3 |
| 29 | 47.5 | Salt | B/E | 1.25/1.25 | — | 4.7 |
| 30 | 47 | Salt | B/E | 1.25/1.25 | 0.5 | 3.7 |

TABLE III

| EX # | $MD_2M$, Amount (g) | Stain | Polyether Siloxane | Polyether Siloxane, Amount (g) | $H_2O$, Amount (g) | Cleaning |
|---|---|---|---|---|---|---|
| 31 | 49.5 | Oil | — | — | — | 5 |
| 32 | 49.5 | Oil | A | 0.5 | — | 5 |
| 33 | 49 | Oil | A | 0.5 | 0.5 | 4.3 |
| 34 | 49.5 | Oil | F | 0.5 | — | 4.3 |
| 35 | 49 | Oil | F | 0.5 | 0.5 | 4.3 |
| 36 | 49.5 | Oil | B | 0.5 | — | 4.3 |
| 37 | 49 | Oil | B | 0.5 | 0.5 | 4.3 |
| 38 | 49.5 | Oil | C | 0.5 | — | 5 |
| 39 | 49 | Oil | C | 0.5 | 0.5 | 5 |
| 40 | 49.5 | Oil | D | 0.5 | — | 5 |
| 41 | 49 | Oil | D | 0.5 | 0.5 | 5 |
| 42 | 49.5 | Oil | E | 0.5 | — | 5 |
| 43 | 49 | Oil | E | 0.5 | 0.5 | 4.7 |
| 44 | 49.5 | Oil | B/E | 0.25/0.25 | — | 4.7 |
| 45 | 49 | Oil | B/E | 0.25/0.25 | 0.5 | 4.7 |

TABLE IV

| EX # | $MD_2M$, Amount (g) | Stain | Polyether Siloxane | Polyether Siloxane, Amount (g) | $H_2O$, Amount (g) | Cleaning |
|---|---|---|---|---|---|---|
| 46 | 47.5 | Oil | — | — | — | 5 |
| 47 | 47.5 | Oil | A | 2.5 | — | 4.3 |
| 48 | 47 | Oil | A | 2.5 | 0.5 | 5 |
| 49 | 47.5 | Oil | F | 2.5 | — | 4.7 |
| 50 | 47 | Oil | F | 2.5 | 0.5 | 4.3 |
| 51 | 47.5 | Oil | B | 2.5 | — | 5 |
| 52 | 47 | Oil | B | 2.5 | 0.5 | 4.3 |
| 53 | 47.5 | Oil | C | 2.5 | — | 5 |
| 54 | 47 | Oil | C | 2.5 | 0.5 | 4 |
| 55 | 47.5 | Oil | D | 2.5 | — | 5 |
| 56 | 47 | Oil | D | 2.5 | 0.5 | 5 |
| 57 | 47.5 | Oil | E | 2.5 | — | 5 |
| 58 | 47 | Oil | E | 2.5 | 0.5 | 5 |
| 59 | 47.5 | Oil | B/E | 1.25/1.25 | — | 4.7 |
| 60 | 47 | Oil | B/E | 1.25/1.25 | 0.5 | 4.3 |

TABLE V

| EX # | $D_5/MD_2M$, Amount (g) | Stain | Polyether Siloxane | Polyether Siloxane, Amount (g) | $H_2O$, Amount (g) | Cleaning |
|---|---|---|---|---|---|---|
| 61 | 24.75/24.75 | Salt | — | — | — | 3 |
| 62 | 24.75/24.75 | Salt | A | 0.5 | — | 4.3 |
| 63 | 24.5/24.5 | Salt | A | 0.5 | 0.5 | 4 |
| 64 | 24.75/24.75 | Salt | F | 0.5 | — | 4 |
| 65 | 24.5/24.5 | Salt | F | 0.5 | 0.5 | 5 |
| 66 | 24.75/24.75 | Salt | B | 0.5 | — | 4.3 |
| 67 | 24.5/24.5 | Salt | B | 0.5 | 0.5 | 5 |
| 68 | 24.75/24.75 | Salt | C | 0.5 | — | 3.3 |
| 69 | 24.5/24.5 | Salt | C | 0.5 | 0.5 | 4 |
| 70 | 24.75/24.75 | Salt | D | 0.5 | — | 4.3 |
| 71 | 24.5/24.5 | Salt | D | 0.5 | 0.5 | 5 |
| 72 | 24.75/24.75 | Salt | E | 0.5 | — | 4 |
| 73 | 24.5/24.5 | Salt | E | 0.5 | 0.5 | 4.7 |
| 74 | 24.75/24.75 | Salt | B/E | 0.25/0.25 | — | 3.3 |
| 75 | 24.5/24.5 | Salt | B/E | 0.25/0.25 | 0.5 | 4 |

TABLE VI

| EX # | $D_5/MD_2M$, Amount (g) | Stain | Polyether Siloxane | Polyether Siloxane, Amount (g) | $H_2O$, Amount (g) | Cleaning |
|---|---|---|---|---|---|---|
| 76 | 24.75/24.75 | Salt | — | — | — | 2.7 |
| 77 | 23.75/23.75 | Salt | A | 2.5 | — | 4.3 |

TABLE VI-continued

| EX # | $D_5/MD_2M$, Amount (g) | Stain | Polyether Siloxane | Polyether Siloxane, Amount (g) | $H_2O$, Amount (g) | Cleaning |
|---|---|---|---|---|---|---|
| 78 | 23.5/23.5 | Salt | A | 2.5 | 0.5 | 5 |
| 79 | 23.75/23.75 | Salt | F | 2.5 | — | 4 |
| 80 | 23.5/23.5 | Salt | F | 2.5 | 0.5 | 4.7 |
| 81 | 23.75/23.75 | Salt | B | 2.5 | — | 4.7 |
| 82 | 23.5/23.5 | Salt | B | 2.5 | 0.5 | 4.7 |
| 83 | 23.75/23.75 | Salt | C | 2.5 | — | 3.3 |
| 84 | 23.5/23.5 | Salt | C | 2.5 | 0.5 | 5 |
| 85 | 23.75/23.75 | Salt | D | 2.5 | — | 4.7 |
| 86 | 23.5/23.5 | Salt | D | 2.5 | 0.5 | 5 |
| 87 | 23.75/23.75 | Salt | E | 2.5 | — | 4 |
| 88 | 23.5/23.5 | Salt | E | 2.5 | 0.5 | 4 |
| 89 | 23.75/23.75 | Salt | B/E | 1.25/1.25 | — | 4.7 |
| 90 | 23.5/23.5 | Salt | B/E | 1.25/1.25 | 0.5 | 3.7 |

TABLE VII

| EX # | $D_5/MD_2M$, Amount (g) | Stain | Polyether Siloxane | Polyether Siloxane, Amount (g) | $H_2O$, Amount (g) | Cleaning |
|---|---|---|---|---|---|---|
| 91 | 24.75/24.75 | Oil | — | — | — | 3 |
| 92 | 24.75/24.75 | Oil | A | 0.5 | — | 4.7 |
| 93 | 24.5/24.5 | Oil | A | 0.5 | 0.5 | 4.7 |
| 94 | 24.75/24.75 | Oil | F | 0.5 | — | 4.3 |
| 95 | 24.5/24.5 | Oil | F | 0.5 | 0.5 | 4.7 |
| 96 | 24.75/24.75 | Oil | B | 0.5 | — | 4.3 |
| 97 | 24.5/24.5 | Oil | B | 0.5 | 0.5 | 4.7 |
| 98 | 24.75/24.75 | Oil | C | 0.5 | — | 4.7 |
| 99 | 24.5/24.5 | Oil | C | 0.5 | 0.5 | 4 |
| 100 | 24.75/24.75 | Oil | D | 0.5 | — | 5 |
| 101 | 24.5/24.5 | Oil | D | 0.5 | 0.5 | 5 |
| 102 | 24.75/24.75 | Oil | E | 0.5 | — | 5 |
| 103 | 24.5/24.5 | Oil | E | 0.5 | 0.5 | 4.7 |
| 104 | 24.75/24.75 | Oil | B/E | 0.25/0.25 | — | 4.3 |
| 105 | 24.5/24.5 | Oil | B/E | 0.25/0.25 | 0.5 | 4.3 |

TABLE VIII

| EX # | $D_5/MD_2M$, Amount (g) | Stain | Polyether Siloxane | Polyether Siloxane, Amount (g) | $H_2O$, Amount (g) | Cleaning |
|---|---|---|---|---|---|---|
| 106 | 24.75/24.75 | Oil | — | — | — | 5 |
| 107 | 23.75/23.75 | Oil | A | 2.5 | — | 4.7 |
| 108 | 23.5/23.5 | Oil | A | 2.5 | 0.5 | 5 |
| 109 | 23.75/23.75 | Oil | F | 2.5 | — | 4.7 |
| 110 | 23.5/23.5 | Oil | F | 2.5 | 0.5 | 4.7 |
| 111 | 23.75/23.75 | Oil | B | 2.5 | — | 5 |
| 112 | 23.5/23.5 | Oil | B | 2.5 | 0.5 | 4.3 |
| 113 | 23.75/23.75 | Oil | C | 2.5 | — | 5 |
| 114 | 23.5/23.5 | Oil | C | 2.5 | 0.5 | 5 |
| 115 | 23.75/23.75 | Oil | D | 2.5 | — | 5 |
| 116 | 23.5/23.5 | Oil | D | 2.5 | 0.5 | 5 |
| 117 | 23.75/23.75 | Oil | E | 2.5 | — | 5 |
| 118 | 23.5/23.5 | Oil | E | 2.5 | 0.5 | 5 |
| 119 | 23.75/23.75 | Oil | B/E | 1.25/1.25 | — | 4.7 |
| 120 | 23.5/23.5 | Oil | B/E | 1.25/1.25 | 0.5 | 4.3 |

TABLE IX

| EX # | $D_5/MD_2M$, Amount (g) | Stain | Polyether Siloxane | Polyether Siloxane, Amount (g) | $H_2O$, Amount (g) | Cleaning |
|---|---|---|---|---|---|---|
| 121 | 4.95/44.55 | Salt | E | 0.5 | — | 2.7 |
| 122 | 4.9/44.1 | Salt | E | 0.5 | 0.5 | 5 |
| 123 | 12.37/37.13 | Salt | E | 0.5 | — | 3 |
| 124 | 12.25/36.75 | Salt | E | 0.5 | 0.5 | 4.7 |

TABLE IX-continued

| EX # | $D_5/MD_2M$, Amount (g) | Stain | Polyether Siloxane | Polyether Siloxane, Amount (g) | $H_2O$, Amount (g) | Cleaning |
|---|---|---|---|---|---|---|
| 125 | 24.75/24.75 | Salt | E | 0.5 | — | 3.5 |
| 126 | 24.5/24.5 | Salt | E | 0.5 | 0.5 | 4.5 |
| 127 | 37.13/12.37 | Salt | E | 0.5 | — | 3 |
| 128 | 36.75/12.25 | Salt | E | 0.5 | 0.5 | 5 |
| 129 | 44.55/4.95 | Salt | E | 0.5 | — | 2.7 |
| 130 | 44.10/4.9 | Salt | E | 0.5 | 0.5 | 4.7 |

Examples 131–162 were conducted using 2"×2" blue 60/40 cotton polyester textile swatches. The salt concentration in the salt solution used to stain the swatches was either 20%, 8% or 7% by weight, as noted in the TABLES X–XIV below. The testing was conducted in the same manner as and the results ranked on the same scale as in Examples 1–130 above. The amounts of linear or cyclic siloxane, polyether siloxane and water used in each of Examples 131–162, as well as the type of stain and the results obtained in each of those examples are set forth in TABLES X–XIV below.

TABLE X

| EX # | $MD_2M$, Amount (g) | Stain (20%) | Polyether Siloxane | Polyether Siloxane, Amount (g) | $H_2O$, Amount (g) | Cleaning |
|---|---|---|---|---|---|---|
| 131 | 49.5 | Salt | — | — | — | 3 |
| 132 | 49.5 | Salt | E | 0.5 | — | 2.7 |
| 133 | 49 | Salt | E | 0.5 | 0.5 | 3 |
| 134 | 49.5 | Salt | C | 0.5 | — | 4 |
| 135 | 49 | Salt | C | 0.5 | 0.5 | 4.3 |
| 136 | 49 | Oil | — | — | — | 5 |
| 137 | 49.5 | Oil | E | 0.5 | — | 5 |
| 138 | 49 | Oil | E | 0.5 | 0.5 | 5 |
| 139 | 49.5 | Oil | C | 0.5 | — | 5 |
| 140 | 49 | Oil | C | 0.5 | 0.5 | 5 |
| 141 | 49 | Salt | E | 0.5 | 1.5 | 4.7 |

TABLE XI

| EX # | $MD_2M$, Amount (g) | Stain (7%) | Polyether Siloxane | Polyether Siloxane, Amount (g) | $H_2O$, Amount (g) | Cleaning |
|---|---|---|---|---|---|---|
| 142 | 49.5 | Salt | — | — | — | 3 |
| 143 | 49.5 | Salt | E | 0.5 | — | 3 |
| 144 | 49 | Salt | E | 0.5 | 0.5 | 5 |
| 145 | 49.5 | Salt | C | 0.5 | — | 4.3 |
| 146 | 49 | Salt | C | 0.5 | 0.5 | 4 |

TABLE XII

| EX # | $D_5/MD_2M$, Amount (g) | Stain (20%) | Polyether Siloxane | Polyether Siloxane, Amount (g) | $H_2O$, Amount (g) | Cleaning |
|---|---|---|---|---|---|---|
| 147 | 24.75/24.75 | Salt | — | — | — | 3.3 |
| 148 | 24.75/24.75 | Salt | E | 0.5 | — | 3.3 |
| 149 | 24.5/24.5 | Salt | E | 0.5 | 0.5 | 3 |
| 150 | 24.75/24.75 | Salt | C | 0.5 | — | 4 |
| 151 | 24.5/24.5 | Salt | C | 0.5 | 0.5 | 4.7 |
| 152 | 24.75/24.75 | Oil | — | — | — | 5 |
| 153 | 24.75/24.75 | Oil | E | 0.5 | — | 5 |
| 154 | 24.5/24.5 | Oil | E | 0.5 | 0.5 | 5 |

TABLE XII-continued

| EX # | $D_5/MD_2M$, Amount (g) | Stain (20%) | Polyether Siloxane | Polyether Siloxane, Amount (g) | $H_2O$, Amount (g) | Cleaning |
|---|---|---|---|---|---|---|
| 155 | 24.75/24.75 | Oil | C | 0.5 | — | 5 |
| 156 | 24.5/24.5 | Oil | C | 0.5 | 0.5 | 5 |
| 157 | 24.75/24.75 | Salt | E | 0.5 | 1.5 | 3.3 |

TABLE XIII

| EX # | $MD_2M$, Amount (g) | Stain (7%) | Polyether Siloxane | Polyether Siloxane, Amount (g) | $H_2O$, Amount (g) | Cleaning |
|---|---|---|---|---|---|---|
| 158 | 24.75/24.75 | Salt | — | — | — | 3.3 |
| 159 | 24.75/24.75 | Salt | E | 0.5 | — | 2 |
| 160 | 24.5/24.5 | Salt | E | 0.5 | 0.5 | 4.7 |
| 151 | 24.75/24.75 | Salt | C | 0.5 | — | 3 |
| 152 | 24.5/24.5 | Salt | C | 0.5 | 0.5 | 2 |

TABLE XIV

| EX # | $D_5/MD_2M$, Amount (g) | Stain (8%) | Polyether Siloxane | Polyether Siloxane, Amount (g) | $H_2O$, Amount (g) | Cleaning |
|---|---|---|---|---|---|---|
| 153 | 4.95/44.55 | Salt | E | 0.5 | — | 2.7 |
| 154 | 4.9/44.1 | Salt | E | 0.5 | 0.5 | 3.7 |
| 155 | 12.37/37.13 | Salt | E | 0.5 | — | 3.3 |
| 156 | 12.25/36.75 | Salt | E | 0.5 | 0.5 | 4.3 |
| 157 | 24.75/24.75 | Salt | E | 0.5 | — | 4 |
| 158 | 24.5/24.5 | Salt | E | 0.5 | 0.5 | 4.3 |
| 159 | 37.13/12.37 | Salt | E | 0.5 | — | 3.7 |
| 160 | 36.75/12.25 | Salt | E | 0.5 | 0.5 | 3.7 |
| 161 | 44.55/4.95 | Salt | E | 0.5 | — | 3.3 |
| 162 | 44.10/4.9 | Salt | E | 0.5 | 0.5 | 4 |

What is claimed is:

1. A method for cleaning a garment, comprising contacting the garment with a cleaning composition comprising a linear or branched volatile siloxane.

2. The method of claim 1, wherein the garment is contacted with the cleaning composition by applying the cleaning composition to at least a localized area of the garment.

3. The method of claim 2, wherein the cleaning composition is removed from the garment by blotting.

4. The method of claim 1, wherein the garment is contacted with the cleaning composition by immersing the garment in the cleaning composition.

5. The method of claim 4, wherein, subsequent to contacting the garment with the cleaning composition, the cleaning composition is separated from the garment by one or more of draining and centrifugation.

6. The method of claim 5, wherein, subsequent to separation of cleaning composition from the garment, the garment is heated to a temperature of from 15° C. to 120° C.

7. The method of claim 5, wherein, subsequent to separation of cleaning composition from the garment, the garment is subjected to reduced pressure.

8. The method of claim 5, wherein, subsequent to separation of cleaning composition from the garment, the garment is heated to a temperature of from 15° C. to 120° C. and subjected to reduced pressure.

9. The method of claim 1, wherein the cleaning composition further comprises a surfactant.

10. The method of claim 1, wherein the cleaning composition further comprises a cyclic siloxane.

11. The method of claim 1, wherein the cleaning composition further comprises a cyclic siloxane and a surfactant.

12. The method of claim 1, wherein the cleaning composition further comprises water.

13. The method of claim 9, wherein the surfactant has the structural formula:

$$M_aD_eD^*_fM^*_{2-a}$$

wherein:

M is $R^9{}_3SiO_{1/2}$;

D is $R^{10}{}_2SiO_{2/2}$;

M* is $R^{11}{}_3SiO_{1/2}$;

D* is $R^{12}{}_2SiO_{2/2}$;

each $R^9$ and $R^{10}$ is independently H, or a monovalent hydrocarbon group, each $R^{11}$ is independently H, a monovalent hydrocarbon group, or $(CH_2)_g—O—(C_2H_4O)_h—(C_3H_6O)_i—(C_nH_{2n}O)_j—R^{13}$, provided that at least one $R^{11}$ is $(CH_2)_g—O—(C_2H_4O)_h—(C_3H_6O)_i—(C_nH_{2n}O)_j—R^{13}$;

each $R^{12}$ is independently H, a monovalent hydrocarbon group, or $(CH_2)_g—O—(C_2H_4O)_h—(C_3H_6O)_i—(C_nH_{2n}O)_j—R^{13}$, provided that at least one $R^{12}$ is $—(CH_2)_g—O—(C_2H_4O)_h—(C_3H_6O)_i—(C_nH_{2n}O)_j—R^{13}$;

$R^{13}$ is H, a monovalent hydrocarbon group or alkyloxy;

$0 \leqq a \leqq 2$;

$0 \leqq e \leqq 1000$;

$0 \leqq f \leqq 50$;

$1 \leqq g \leqq 16$;

$0 \leqq h \leqq 30$;

$0 \leqq i \leqq 30$;

$0 \leqq j \leqq 30$; and $4 \leqq n \leqq 8$ provided that $h+i+j>0$ and $f>0$ if a is 2.

* * * * *